US008768201B2

(12) United States Patent
Ming Wang

(10) Patent No.: US 8,768,201 B2
(45) Date of Patent: Jul. 1, 2014

(54) IMAGE FORMING APPARATUS

(75) Inventor: Wei Ming Wang, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 125 days.

(21) Appl. No.: 13/429,531

(22) Filed: Mar. 26, 2012

(65) Prior Publication Data

US 2012/0308258 A1 Dec. 6, 2012

(30) Foreign Application Priority Data

May 31, 2011 (JP) ..... 2011-121963

(51) Int. Cl.
*G03G 15/00* (2006.01)

(52) U.S. Cl.
USPC ..... 399/107

(58) Field of Classification Search
USPC ..... 399/107, 110
See application file for complete search history.

(56) References Cited

U.S. PATENT DOCUMENTS

| | | | | |
|---|---|---|---|---|
| 7,302,200 | B2 | 11/2007 | Washio et al. | |
| 7,369,788 | B2 | 5/2008 | Omura et al. | |
| 7,450,878 | B2 | 11/2008 | Yano | |
| 7,483,645 | B2 | 1/2009 | Omura et al. | |
| 7,959,846 | B2 * | 6/2011 | White et al. | 264/342 R |
| 2005/0008393 | A1 | 1/2005 | Kuma et al. | |
| 2006/0140659 | A1 | 6/2006 | Washio et al. | |
| 2006/0153587 | A1 | 7/2006 | Omura et al. | |
| 2006/0291893 | A1 * | 12/2006 | Yano | 399/90 |
| 2008/0193156 | A1 | 8/2008 | Omura et al. | |

FOREIGN PATENT DOCUMENTS

| | | |
|---|---|---|
| JP | 2005-049553 | 2/2005 |
| JP | 2006145773 A | 6/2006 |
| JP | 2006184858 A | 7/2006 |
| JP | 2007-003925 | 1/2007 |
| JP | 2010-079212 | 4/2010 |

OTHER PUBLICATIONS

Translation of Kuma JP 2005-049553 A, pub date Feb. 24, 2005.*
Notification of Reasons for Rejection issued in corresponding Japanese Patent Application No. 2011-121963 dated Apr. 23, 2013.

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus including a main frame, an image forming unit, which is disposed on an inner side of the main frame, a power board, which is disposed on the inner side of the main frame and is configured to apply voltage to the image forming unit, and a holder member, which is detachably attached to a surface on an outer side of the main frame and is configured to hold a wire connecting the power board and the image forming unit electrically, is provided.

8 Claims, 9 Drawing Sheets

IMAGE FORMING APPARATUS

CROSS REFERENCE TO RELATED APPLICATION

This application claims priority from Japanese Patent Application No. 2011-121963, filed on May 31, 2011, the entire subject matter of which is incorporated herein by reference.

BACKGROUND

1. Technical Field

An aspect of the present invention relates to an image forming apparatus, which is capable of forming an image in an electrophotographic method, and more specifically, to a wire arrangement in the image forming apparatus.

2. Related Art

An electrophotographic printer, such as a laser printer, with an image forming unit including a photosensitive member to carry a toner image and a toner cartridge containing toner is known. The laser printer may have, for example, an image-processing cartridge with a photosensitive drum and a toner cartridge, a high-voltage power feeder board to supply electricity to the processing cartridge, and a casing to contain the processing cartridge and the power feeder board.

In the laser printer, a bundle of wires connecting the power feeder board with the processing cartridge may be arranged to be partially exposed to an outer side of the casing whilst one end of the wire bundle may be connected to the power feeder board, which is disposed inside the casing. In this regard, the wires may be laid out directly on the casing.

SUMMARY

When the bundle of wires to be arranged directly on the casing is installed in the laser printer, the wires may be drawn outside the casing whilst the one end of the wire bundle is maintained connected to the power feeder board in order for the wire bundle to be routed outside the casing. Such wire-routing and assembling procedures may be confusing and make installation of the wires difficult or cumbersome.

In view of the difficulty, the present invention is advantageous in that an image forming apparatus, in which the wires connecting the power board with the image forming unit is installed easily in a frame assembly, is provided.

According to an aspect of the present invention, an image forming apparatus is provided. The image forming apparatus includes a main frame, an image forming unit, which is disposed on an inner side of the main frame, a power board, which is disposed on the inner side of the main frame and is configured to apply voltage to the image forming unit, and a holder member, which is detachably attached to a surface on an outer side of the main frame and is configured to hold a wire connecting the power board and the image forming unit electrically.

BRIEF DESCRIPTION OF THE ACCOMPANYING DRAWINGS

Figure 6A:
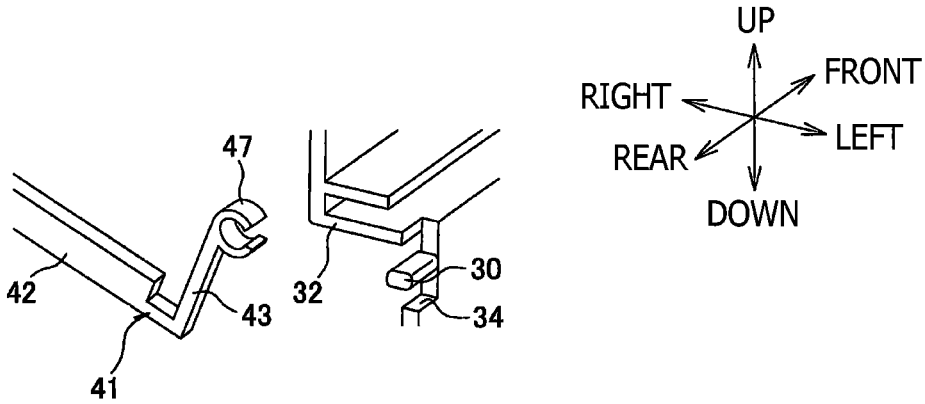
Figure 6B:
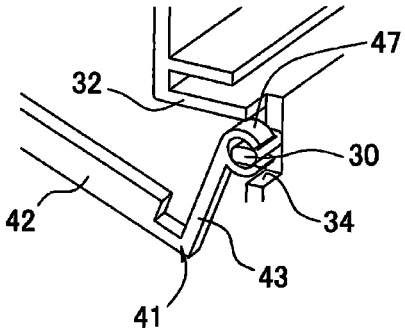

FIG. 6A is an enlarged partial view of an engageable cylinder in the wire holder detached from an engageable shaft of the right-side frame in the printer according to the embodiment of the present invention. FIG. 6B is an enlarged partial view of the engageable cylinder in the wire holder attached to the engageable shaft of the right-side frame in the printer according to the embodiment of the present invention.

Figure 7A:
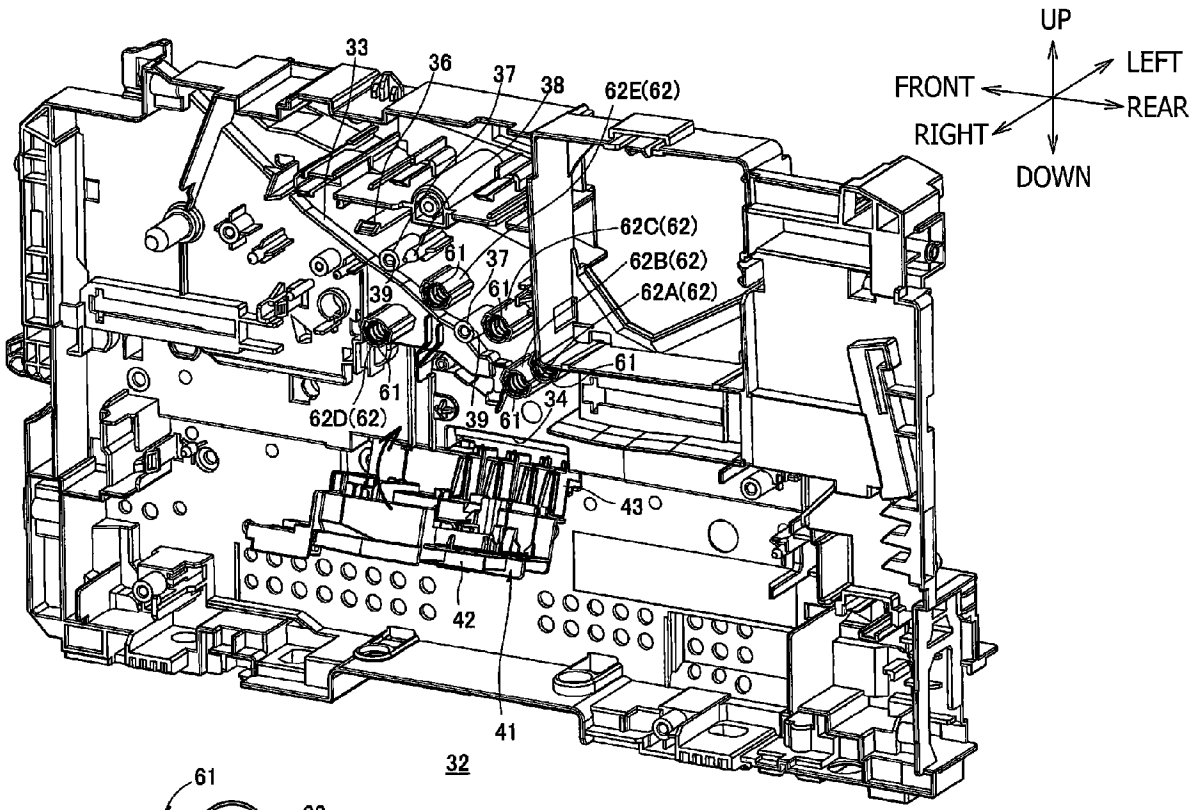
Figure 7B:
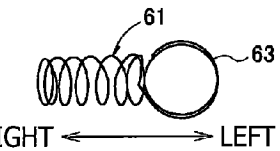

FIG. 7A is a perspective view of the holder piece attached to the right-side frame in the printer according to the embodiment of the present invention viewed from a rear-right position. FIG. 7B is a side partial view of a relay electrode in the printer according to the embodiment of the present invention.

Figure 8:
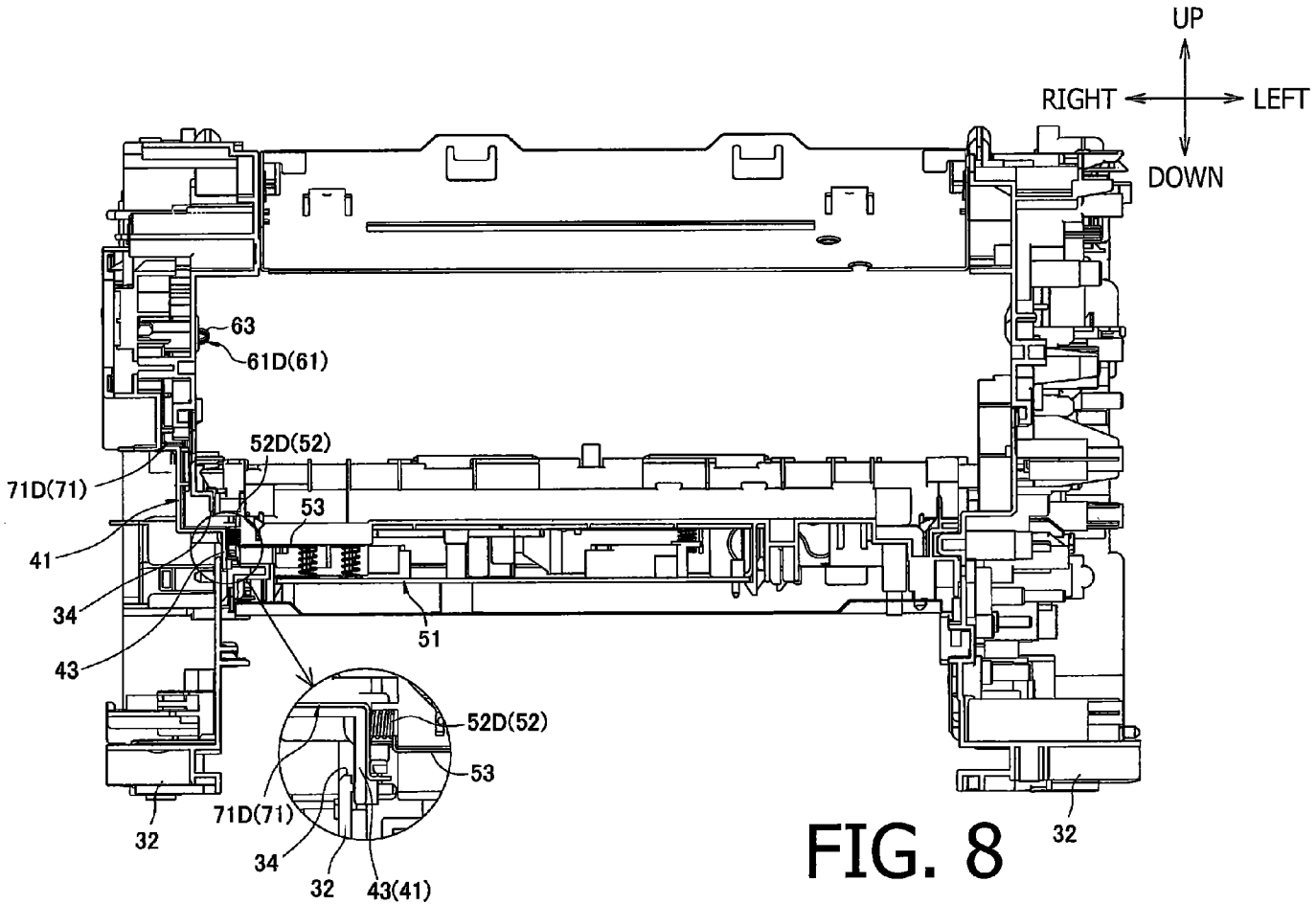

FIG. 8 is a plane view of the frame assembly in the printer according to the embodiment of the present invention.

Figure 9:
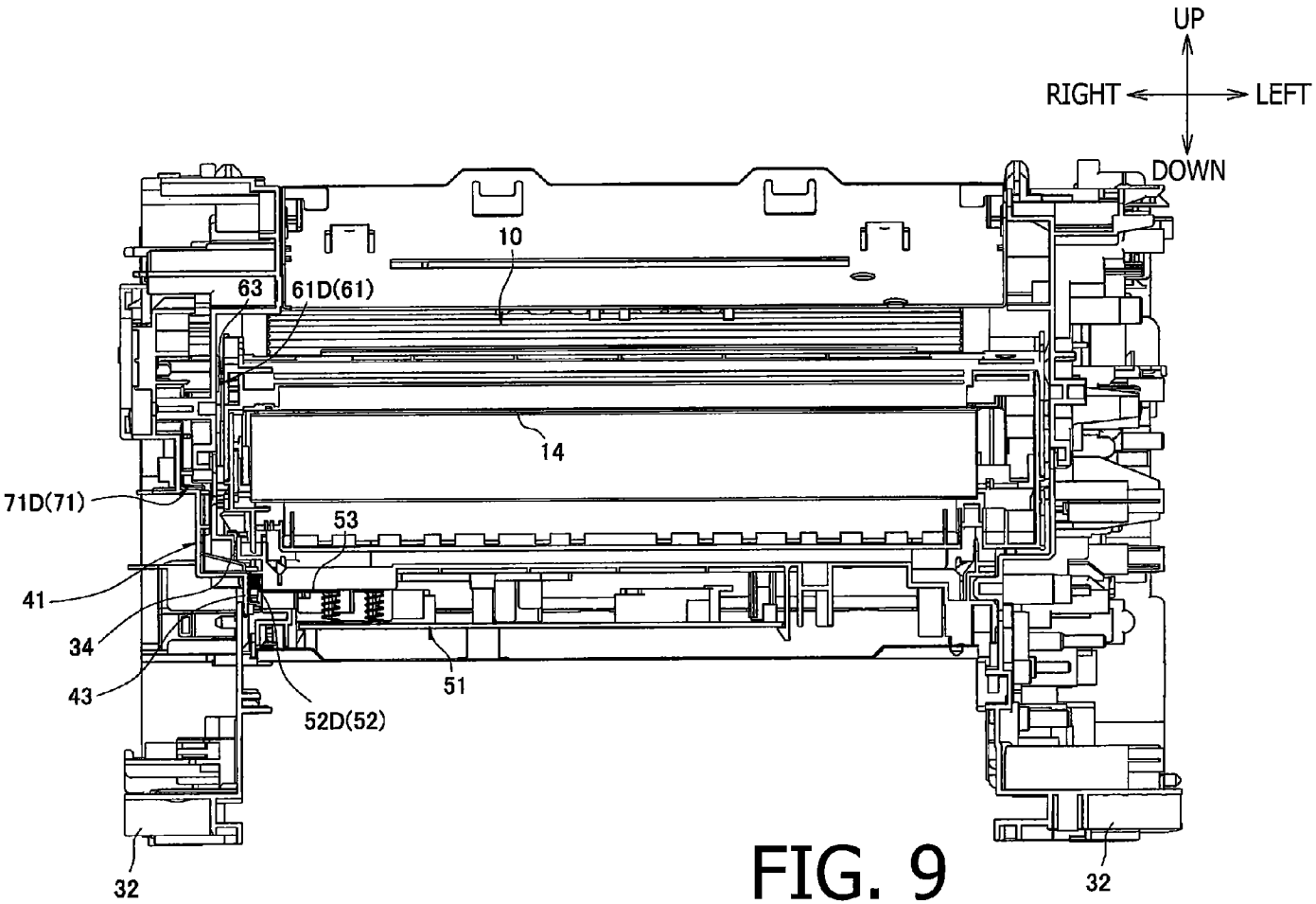

FIG. 9 is a plane view of the frame assembly of the printer according to the embodiment of the present invention with the processor cartridge installed therein.

DETAILED DESCRIPTION

Hereinafter, an embodiment according to an aspect of the present invention will be described with reference to the accompanying drawings.

1. Overall Configuration of Printer 1

Figure 1:
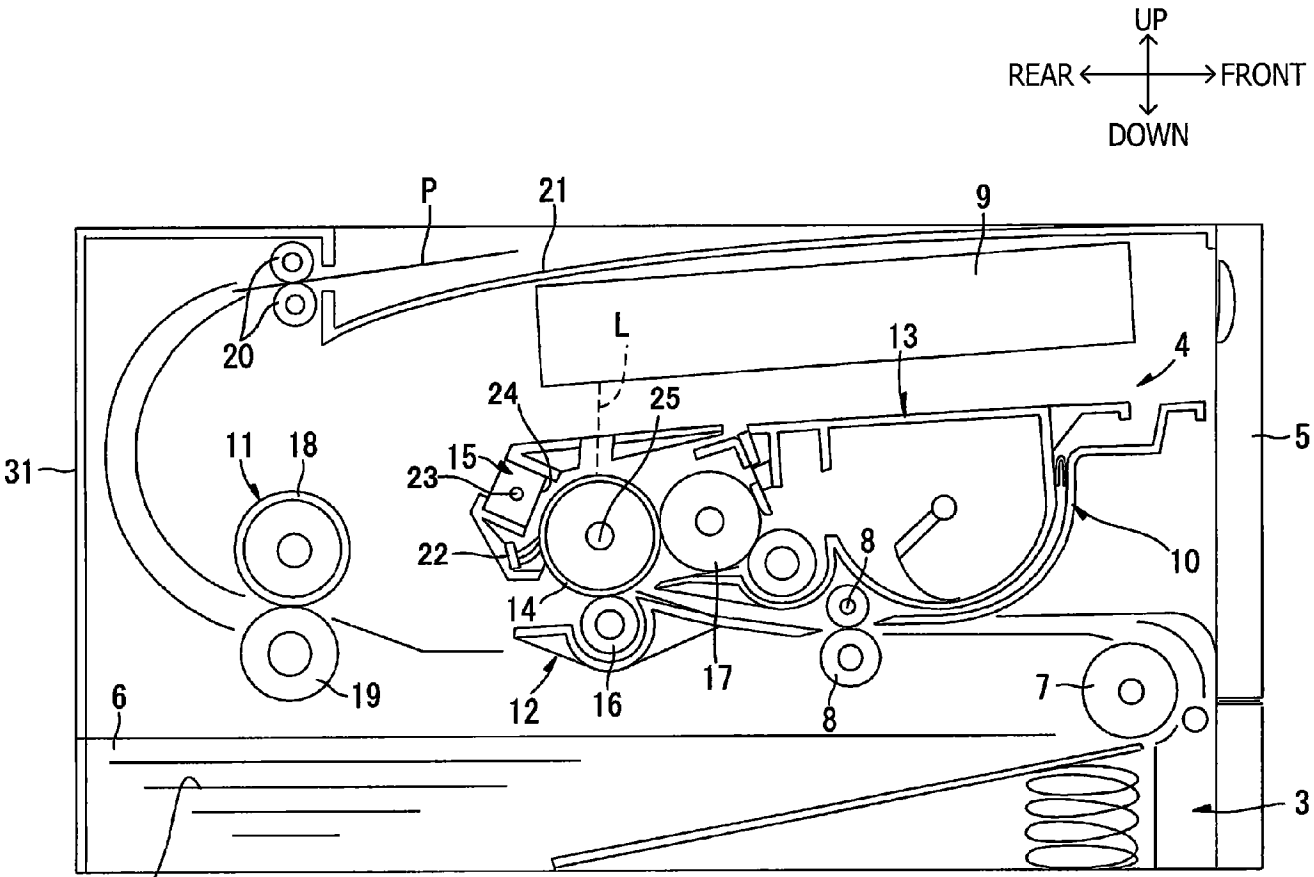
FIG. 1 is a cross-sectional side view of a printer according to an embodiment of the present invention.

FIG. 1 is a cross-sectional side view of a printer 1 as an example of an image forming apparatus according to an embodiment of the present invention. The printer 1 has a sheet-feeder unit 3 and an image forming unit 4, which are stored in a main housing 31 being a chassis.

On one side (e.g., a front side) of the main housing 31, the printer 1 has a front cover 5. The front cover 5 is openable and closable to cover and uncover an opening (not shown), and when the front cover 5 is open, a processing unit 10 can be installed in and removed from the printer 1 through the exposed opening. In the present embodiment, directions concerning the printer 1 will be referred to based on the orientation indicated by arrows shown in each drawing. In particular, a viewer's right-hand side in FIG. 1, on which the front cover 5 is arranged, is referred to as front, and a side opposite from the front, which is the viewer's left-hand side in FIG. 1 is referred to as rear. The front-rear direction of the image forming apparatus 1 may also be referred to as a direction of depth. A side, which corresponds to the viewer's nearer side is referred to as a left-side face of the printer 1, and an opposite side from the left, which corresponds to the viewer's further side, is referred to as a right-side face of the printer 1. The right-left direction of the image forming apparatus 1 may also be referred to as a widthwise direction. The up-down direction in FIG. 1 corresponds to a vertical direction of the image forming apparatus.

1.1 Sheet-Feeder Unit

The sheet-feeder unit 3 will be described. The sheet-feeder unit 3 includes a sheet-feed tray 6, in which a stack of sheets P being recording media can be stored. The sheet-feed tray 6 is detachably attached in a lower section of the printer 1 through a front part of the printer 1. In an upper front position of the sheet-feed tray 6, a feeder roller 7 is arranged. Further, in a rear position with respect to the feeder roller 7, a pair of register rollers 8 is arranged.

The sheets P in the sheet-feed tray 6 are picked up one-by-one by the feeder roller 7 as the feeder roller rotates and forwarded to the register rollers 8. Further, as the register rollers 8 rotate, the sheets P are conveyed to the image forming unit 4 in predetermined timings.

1.2 Image Forming Unit

The image forming unit 4 will be described. The image forming unit 4 includes a scanner unit 9, a processing unit 10, and a fixing unit 11.

1.2.1 Scanner Unit

The scanner unit 9 is arranged in an upper position in the printer 1. The scanner unit 9 emits laser beam L to a photosensitive drum 14 in the processing unit 10 as indicated by a chain line in FIG. 1. The laser beam L scans a surface of the photosensitive drum 14 along the widthwise direction, which is a main scanning direction. Thus, the photosensitive drum 14 is exposed to the laser beam L.

1.2.2 Processing Unit

The processing unit 10 is arranged in a lower position with respect to the scanner unit 9 in the printer 1. The processing unit 10 includes a drum cartridge 12 and a developer cartridge 13. The developer cartridge 13 is detachably attached to the drum cartridge 12.

In the drum cartridge 12, a cylinder-shaped photosensitive drum 14 is rotatably arranged to align the widthwise direction of the printer 1. In each longitudinal end of the photosensitive drum 14, a drum shaft 25 is provided. The drum shaft 25 is made of a conductive material and is formed to have a shape of a thin cylindrical bar, which extends along the widthwise direction of the printer 1, and is arranged coaxially with the photosensitive drum 14. A widthwise end of the drum shaft 25 extends outward beyond a widthwise end of the drum cartridge 12.

The drum cartridge 12 has a scorotoron charger 15, which is arranged in an upper rear position in the drum cartridge 12. The scorotoron charger 15 includes a wire 23 and a grid 24. The wire 23 is arranged in an upper rear position with respect to the photosensitive drum 14 to face the photosensitive drum 14 with clearance maintained between them. The grid 24 is arranged in an intervening position between the photosensitive drum 14 and the wire 23.

Further, in the drum cartridge 12, a drum cleaner 22 is provided in a rear position with respect to the photosensitive drum 14. The drum cleaner 22 includes a piece of unwoven cloth, on which conductive brush filament is planted, and is arranged to be in contact with the surface of the photosensitive drum 14. With the photosensitive drum 14 being in contact with the blush in the drum cleaner 22, and when cleaning bias is applied to the drum cleaner 22, toner and dust remaining on the surface of the photosensitive drum 14 can be removed by the brush.

Furthermore, in the drum cartridge 12, a transfer roller 16 is provided in a lower position with respect to the photosensitive drum 14.

The developer cartridge 13 is arranged in a position closer to the front with respect to the photosensitive drum 14 and includes a developer roller 17.

The developer roller 17 is rotatably supported in a rear position within the developer cartridge 13 and is exposed from a rear end of the developer cartridge 13 to face the photosensitive drum 14. In particular, the developer roller 17 is in a front position with respect to the photosensitive drum 14 to be urged against the circumferential surface of the photosensitive drum 14.

Further, the developer cartridge 13 has a room to contain toner therein in a front position with respect to the developer roller 17.

1.2.3 Developing and Transferring Operations

The toner contained in the developer cartridge 13 is carried by the circumferential surface of the developer roller 17 as the developer roller 17 rotates. Meanwhile, the circumferential surface of the photosensitive drum 14 is evenly charged by the scorotoron charger 15 and exposed to the laser beam L emitted from the scanner unit 9. Thus, a latent image reflecting the image to be formed on the recording sheet P is formed on the circumferential surface of the photosensitive drum 14.

As the photosensitive drum 14 rotates further, the toner on the circumferential surface of the developer roller 17 is supplied to the latent image on the circumferential surface of the photosensitive drum 14. Accordingly, the latent image on the circumferential surface of the photosensitive drum 14 is developed to be a reversed toner image. The toner image is transferred onto the surface of the recording sheet P as the recording sheet P is conveyed in a position between the photosensitive drum 14 and the transfer roller 16.

1.2.4 Fixing Unit

The fixing unit 11 is arranged in a rear position with respect to the processing unit 10 and includes a heat roller 17 and pressure roller 19, which is pressed against the heat roller 18. The toner image transferred onto the recording sheet P is thermally fixed thereat by the heat and the pressure applied from the heat roller 17 and the pressure roller 19 as the recording sheet P is conveyed in between the heat roller 17 and the pressure roller 19.

1.3. Ejection of Recording Sheet

The recording sheet P with the fixed toner image is carried toward a pair of discharge rollers 20 and ejected to be released in a discharge tray 21, which is formed on an upper plane of the printer 1.

2. Main Housing and Lateral Walls

The printer 1 includes the main housing 31 (see FIG. 1), which forms an external shape of the printer 1, and a pair of lateral walls 32 (see FIG. 2), which are plate frames to be arranged inside the main housing 31. The main housing 31 of the printer 1 is formed to have a box-like shape and has the front cover 5 at the front face thereof. The lateral walls 32 are made of resin such as acrylonitrile butadiene styrene (ABS) resin, and each of the lateral walls 32 is formed in a rectangular plate, when viewed along the widthwise direction, with thickness. In particular, the lateral walls 32 are arranged in right and left opposite and facing positions from each other in the main housing 31, and in these positions, a direction of the thickness of the lateral walls 32 coincides with the widthwise direction.

According to the present embodiment, solely one of the lateral walls 32 on the right-hand side along the widthwise direction is provided with power-feeding configuration to feed electricity to the processing unit 10. Therefore, in the following description, solely the one of the lateral walls 32 on the right-hand side is described in detail, and description of the other one of the lateral walls 32 on the left-hand side will be omitted. Further, in the following description, the terms "lateral wall 32" mentioned in a singular form may represent the one of the lateral walls 32 on the right-hand side unless otherwise noted. It is to be noted that a left-side face of the "lateral wall 32" on the right faces inward, and a right-side face of the lateral wall 32 faces outward along the widthwise direction.

2.1 Guide Groove

Figure 2:
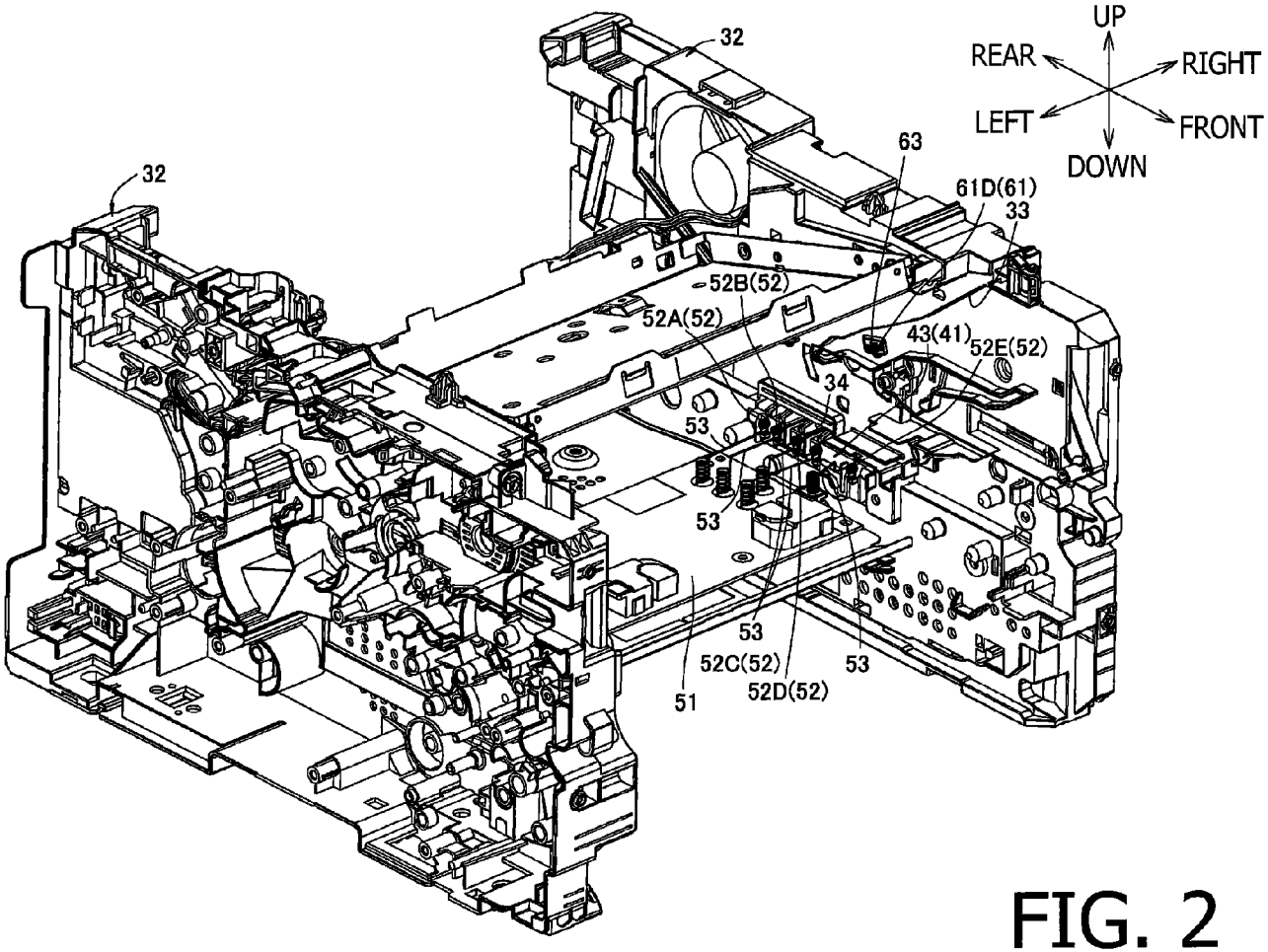
FIG. 2 is a perspective view of a frame assembly in the printer according to the embodiment of the present invention.
Figure 3:
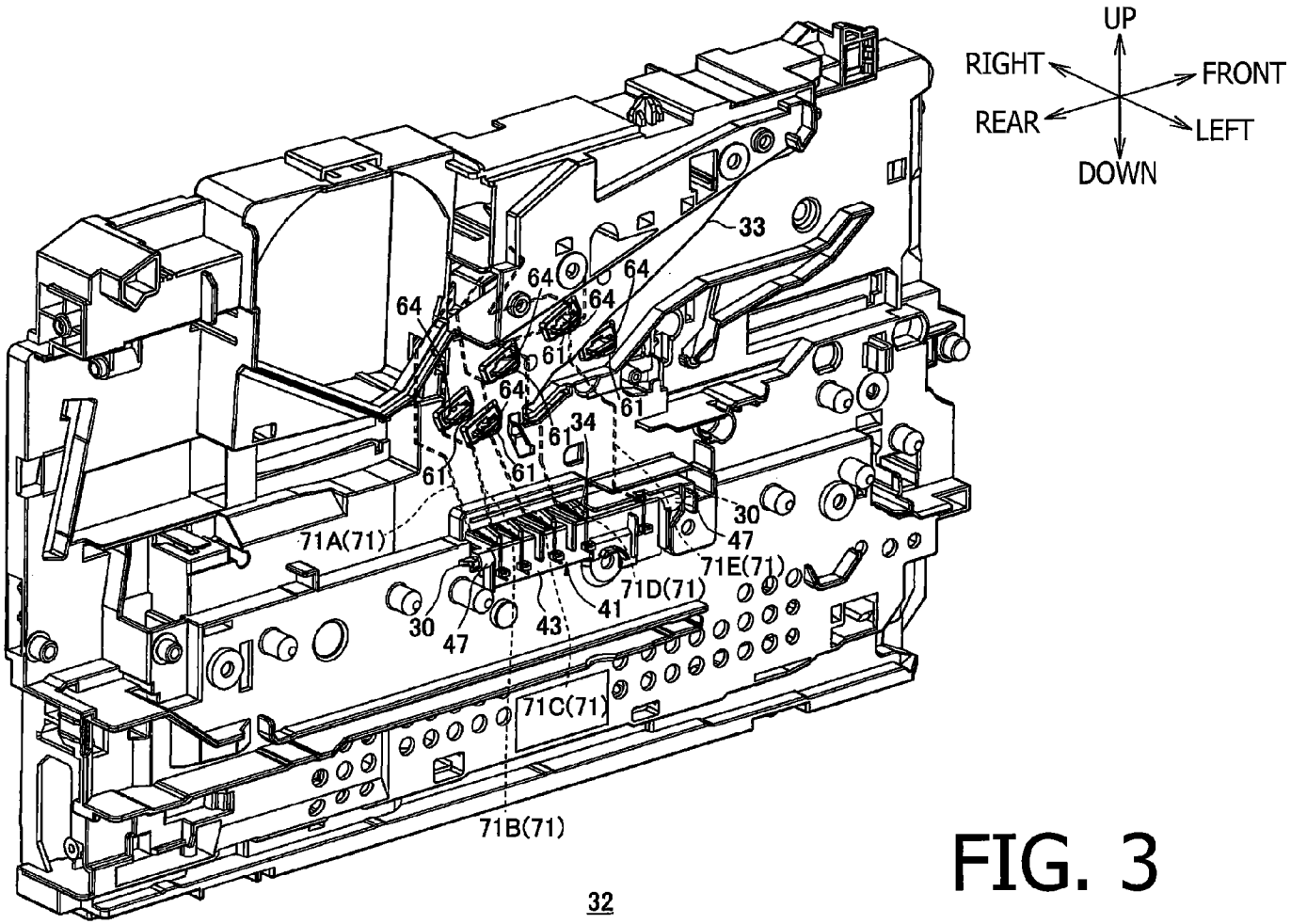
FIG. 3 is a perspective view of a lateral wall on a right-hand side in the frame assembly of the printer according to the embodiment of the present invention viewed from a rear-left position.

As shown in FIGS. 2 and 3, the lateral wall 32 is formed to have a guide groove 33, which guides the processing unit 10 when the processing unit 10 is installed in and removed from the printer 1.

The guide groove 33 is formed to extend from an upper-front end of the lateral wall 32 toward a lower-rear position to an approximate center (i.e., a center of the front-rear dimension and a vertical center of up-down dimension) of the lateral wall 32. The guide groove 33 is formed to recess rightward and is formed to have a shape of "V" in a side view with the upper-right end thereof being open.

When the processing unit 10 is fully installed in the printer 1, a drum shaft 25 of the photosensitive drum 14 is caught in the rear end section of the guide groove 33.

2.2 Configuration for Supporting a Wire Holder

Figure 4:
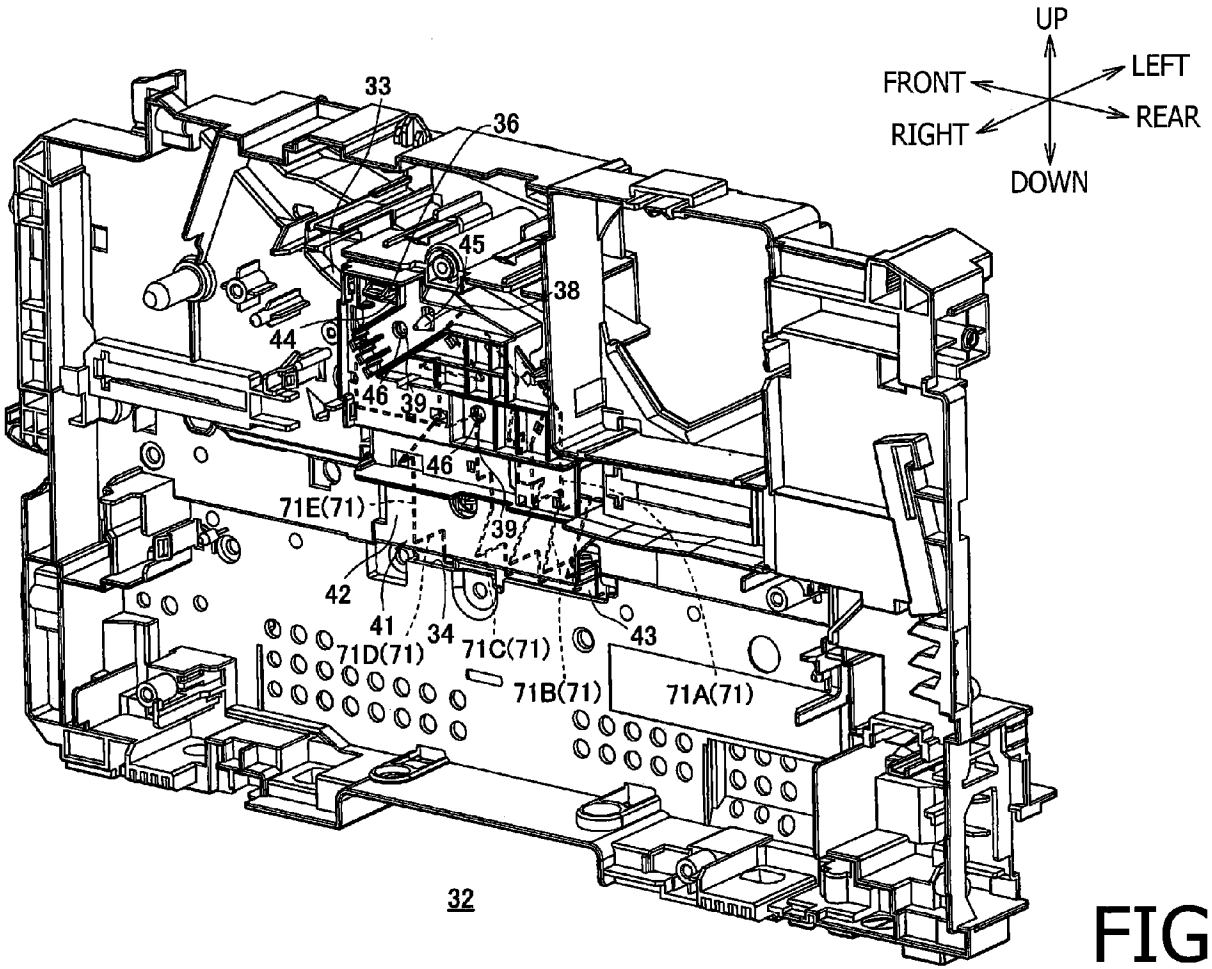
FIG. 4 is another perspective view of the lateral wall on the right-hand side in the frame assembly of the printer according to the embodiment of the present invention viewed from a rear-right position.

In a lower position with respect to the rear end of the guide groove 33, a cutout opening 34 (see FIGS. 3 and 4) is formed in the lateral wall 32. Further, in proximate positions to the opening 34 on a front side and on a rear side of the opening 34 along the front-rear direction, engageable shafts 30 are provided.

The opening 34 penetrates the thickness of the lateral wall 32 along the widthwise direction and is formed to have a shape of a rectangle, of which longer sides extend along the front-rear direction. Through the opening 34, space on the inner side of the lateral wall 32 and space on the outer side of the lateral wall 32 are in communication with each other. The opening 34 is formed to support a lower part of a wire holder 41, which will be described later in detail.

One of the engageable shafts 30 (see FIG. 3) is provided in the rear position with respect to the opening 34 and is formed to protrude frontward from a rear edge of the opening 34. The other one of the engageable shafts 30 (see FIGS. 6A-6B) is provided in the front position with respect to the opening 34 and is formed to protrude rearward from a front edge of the opening 34. The engageable shafts 30 are formed to have a vertically-flattened elliptic cross-section (see FIGS. 6A-6B).

The lateral wall 32 further has a holder locking claw 36, a positioning shaft 38, and a pair of screw cylinders 37.

The holder locking claw 36 is provided in an upper position with respect to the guide groove 33 and is formed in a thin bar protruding rightward from the right-side face of the lateral wall 32. A right-side open end of the holder locking claw 36 is formed to have a shape of a hook, which points upward.

The positioning shaft 38 is provided in an upper position with respect to the guide groove 33 and in a rear and spaced-apart position from the holder locking claw 36. The positioning shaft 38 is formed in a cylinder protruding rightward from the right-side face of the lateral wall 32. A right-side open end of the positioning shaft 38 is formed conically.

One of the screw cylinders 37 is provided in an intermediate position between the holder locking claw 36 and the positioning shaft 38, in particular, in a lower-rear position with respect to the holder locking claw 36 and in a lower-front position with respect to the positioning shaft 38. The other one of the screw cylinder 37 is provided in an upper position with respect to the rear end of the guide groove 33. Each screw cylinder 37 is formed to have a shape of a cylinder, which extends rightward from the right-side face of the lateral wall 32, and a screw hole 39, which is recessed from the right-side end of the screw cylinder 37 inwardly toward left, is formed in a radial center of the cylindrical shape of the screw cylinder 37.

2.3 High-Voltage Power Feeder Board

The printer 1 has a high-voltage power feeder board 51 on an inner side between the lateral walls 32 in a lower position with respect to the processing unit 10 (see FIG. 2).

The power feeder board 51 is an electric circuit board having a voltage converter and a capacitor, which are not shown. The power feeder board 51 amplifies voltage supplied from a power source (not shown), stores the amplified high voltage (bias) in the capacitor, and supplies the amplified high voltage to the components in the printer 1 through power conductive wires, which will be described later in detail.

The power feeder board 51 includes a plurality of (e.g., five) pieces of on-board wires 53, which extend in coils upward from a predetermined output points and bent rightward at top ends of the coils. The power feeder board 51 further includes five pieces of electrodes 52, which are connected to the rightward ends of the on-board wires 53 respectively.

The electrodes 52 are arranged to be spaced apart from one another along the front-rear direction in an upper area with respect to a right-side edge of the power feeding board 51. More specifically, the electrodes 52 has a first electrode 52A for cleaner and a second electrode 52B for cleaner, which apply the voltage to the drum cleaner 22, an electrode 52C for grid, which applies the voltage to the grid 24 in the scorotoron charger 15, an electrode 52D for developer roller, which applies the voltage to the developer roller 17, and an electrode 52E for charger-wire, which feeds power to the wire 23 in the scorotoron charger 15. The electrodes 52A, 52B, 52C, 52D, and 52E are disposed to align in line, from rear toward front, in an order recited above. In particular, the electrodes 52A, 52B, 52C, and 52D are disposed in evenly-spaced positions from each other whilst the electrode 52E for charger-wire is disposed in a frontward position with respect to the electrode 52D for developer roller with a larger amount of clearance, larger than the even space between the electrodes 52A, 52B, 52C, and 52D respectively, apart from the electrode 52D.

2.4 Relay Electrodes

The lateral wall 32 supports a plurality of (e.g., five) relay electrodes 61 (see FIG. 7A), which supply power to the processing unit 10.

Each relay electrode 61 is made of a conductive and resilient material such as a metal and is coiled to extend along the widthwise direction. A left-side end of the relay electrode 61 is curled in a ring shape to serve as a contact point 63 (see FIG. 7B).

Each relay electrode 61 is inserted in one of five relay electrode receptacles 62 (see FIG. 7A) to be held by the lateral wall 32. In other words, the lateral wall 32 is formed to have the five relay electrode receptacles 62 to accommodate the relay electrodes 61.

Each relay electrode receptacle 62 is formed to have a shape of a cylinder, which protrudes rightward (i.e., outward) from the right-side (i.e., the outer side) face of the lateral wall 32. The lateral wall 32 is formed to have five exposing grooves 64 (see FIG. 3), through which the contact points 63 of the relay electrodes 61 set in the relay electrode receptacles 62 are exposed to the left side (i.e., the inner side) of the lateral wall 32, in the positions in which the relay electrode receptacles 62 are arranged. In order for the right-side end of the relay electrode 61 to be exposed from the relay electrode receptacle 62, i.e., in order to prevent the relay electrode 61 from being fully enclosed in the relay electrode receptacle 62, each relay electrode receptacle 62 is formed to be in a smaller dimension along the right-left direction than a dimension, along the right-left direction, of the coil of the relay electrode 61. Therefore, the relay electrodes 61 are accommodated in the relay electrode receptacles 62 along the widthwise direction with the contact points 63 thereof exposed to the left-hand side of the lateral wall 32 through the exposing grooves 64 and with the right-side ends thereof exposed from the right-side ends of the relay electrode receptacles 62.

The relay electrode receptacles 62 include a first receptacle 62A for cleaner and a second receptacle 62B for cleaner, which accommodate the relay electrodes 61 for applying the voltage to the drum cleaner 22, a receptacle 62C for grid, which accommodates the relay electrode 61 for applying the voltage to the grid 24 in the scorotoron charger 15, a receptacle 62D for developer roller, which accommodates the relay electrode 61 for applying the voltage to the developer roller 17, and a receptacle 62E, which accommodates the relay electrode 61 for feeding power to the wire 23 in the scorotoron charger 15.

The first and the second receptacles 62A, 62B for cleaner are formed on the right-side face of the lateral wall 32 in front positions with respect to a position corresponding to the guide groove 33, which is formed on the left-side face of the lateral wall 32, and in vertically and horizontally different positions from each other. In particular, the first receptacle 62A is in an upper-rear position with respect to the second receptacle 62B. In other words, the second receptacle 62B is in a lower-front position with respect to the first receptacle 62A. The receptacle 62C for grid is formed in an upper position with respect to a position, on the right-side face of the lateral wall 32, corresponding to the rear end of the guide groove 33 and in a rear position with respect to one of the screw cylinders 37 which is closer to the rear. The receptacle 62D for developer roller is formed in a position, on the right-side face of the lateral wall 32, horizontally corresponding to the guide groove 33 and in a lower position with respect to the other of the screw cylinders 37 closer to the front. The receptacle 62E for charger-wire is formed, on the right-side face of the lateral wall 32, in an upper position with respect to a position corresponding to the guide groove 33 and in an intermediate position between the two screw cylinders 37.

3. Wire Holder

3.1 Configuration for Attaching the Wire Holder to the Lateral Wall

Figure 5:
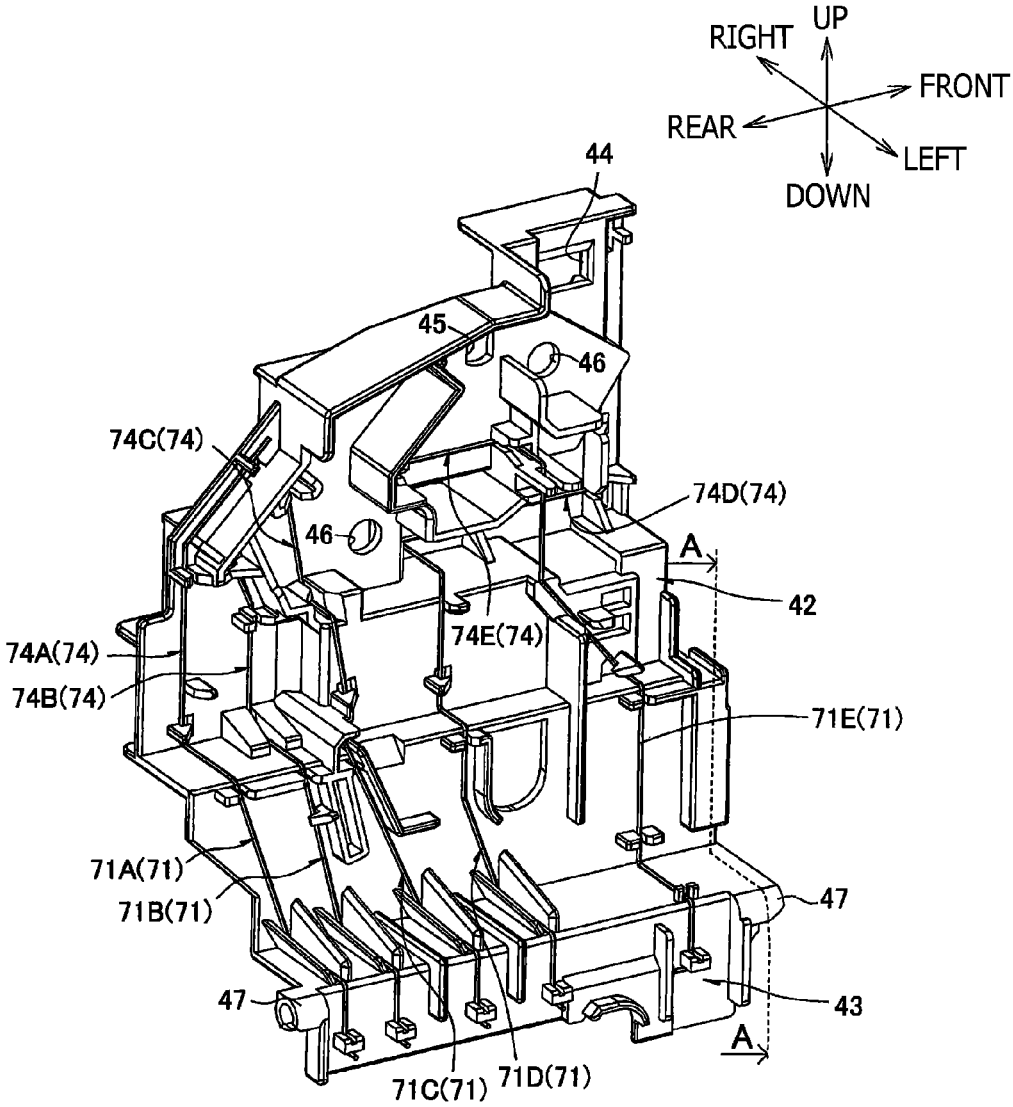
FIG. 5 is a perspective view of a wire holder in the printer according to the embodiment of the present invention viewed from a rear-left position.

The lateral wall 32 has the wire holder 41 (see FIG. 5) attached on the right-side face thereof. The wire holder 41 is made of flame-resistant resin such as PC/ABS resin being polymer alloy made of polycarbonate and acrylonitrile butadiene styrene copolymer. The wire holder 41 is formed to have a first part 42 (see FIG. 4), which is to be disposed on the right-hand side of the lateral wall 32 to face the lateral wall 32, and a second part 43 (see FIG. 3), which extends leftward continuously from a lower end of the first part 42. The second part 43 is disposed on the left-hand side of the lateral wall 32 to protrude through the opening 34 leftward with respect to the lateral wall 32. Thus, the first part 42 and the second part 43 are disposed in opposite positions from each other across the opening 34 in the lateral wall 32.

The first part 42 is formed, when viewed from front, in a shape of crank extending upward from the second part 43 and includes an engageable opening 44, a shaft hole 45, and a pair of exposing holes 46 in an upper section thereof. The engageable hole 44 allows the holder locking claw 36 to penetrate therethrough and the hook of the holder locking claw 36 to be hooked to an upper edge of the engageable hole 44. Thus, the engageable hole 44 can be engaged with the holder locking claw 36 of the lateral wall 32. The shaft hole 45 allows the positioning shaft 38 of the lateral wall 32 to be inserted therethrough. The exposing holes 45 allow the screw holes 39 of the screw cylinders 37 to be exposed to the right side of the wire holder 41.

The engageable hole 44 penetrates thickness of the first part 42 and is formed to have a shape of rectangle, in a side view, of which longer sides extend along the front-rear direction. In particular, the engageable hole 44 is formed to have a greater dimension along the front-rear direction and a greater height along the vertical direction than the dimension of the holder locking claw 36 along the front-rear direction and the height of the holder locking claw 36 along the vertical direction.

The shaft hole 45 is formed in a rear and spaced-apart position with respect to the engageable hole 44 and in a shape of vertically-elongated rectangle in a side view. The shaft hole 45 is formed to have a dimension along the front-rear direction, which is substantially equivalent to (or slightly greater than) a diameter of the positioning shaft 38.

One of the exposing holes 46 is formed in an intermediate position between the engageable hole 44 and the shaft hole 45, in particular, in a lower-rear position with respect to the engageable hole 44 and in a lower-front position with respect to the shaft hole 45. The other one of the exposing holes 46 is formed approximately in a center of the dimension along the front-rear direction of the first part 42. Each exposing hole 46 is formed to penetrate the first part 42 in a circular shape having a diameter which is greater than the diameter of the screw hole 39.

The second part 43 extends leftward from the lower end of the first part 42 and is bent downward at a left-side end thereof to form a shape of an "L" in a side view. The second part 43 is formed to have a pair of engageable cylinders 47, which are engaged with the engageable shafts 30, to be supported by the lateral wall 32.

The engageable cylinders 47 are formed at a front end and a rear end of the bent part of the second part 43 respectively. Each engageable cylinder 47 is formed to have a shape of a pipe extending in the direction of depth along the front-rear direction, and a lower end sector thereof is cut open. Therefore, a cross-section of the engageable cylinder 47 has a shape of a "C." An inner diameter of the engageable cylinder 47 is substantially equivalent to (or slightly greater than) the longer (widthwise) dimension of the elliptic shape of the engageable shaft 30. A circumferential amount of the cut-opening is slightly smaller than the shorter (vertical) dimension of the elliptic shape of the engageable shaft 30.

3.2 Wire Arrangement in the Wire Holder

The wire holder 41 supports five pieces of wires 71 (see FIG. 5), which electrically connects the electrodes 52 on the high-voltage power feeder board 51 with the relay electrodes 61 respectively. The wires 71 are made of a conductive material such as a metal and formed in lines to be arranged along the crank of the wire holder 41.

The wires 71 include a first wire 71A for cleaner and a second wire 71B for cleaner, which are to apply the voltage to the drum cleaner 22, a wire 71C for grid, which is to apply the voltage to the grid 24 in the scorotoron charger 15, a wire 71D for developer roller, which is to apply the voltage to the developer roller 17, and a wire 71E for charger-wire, which is to feed power to the wire 23 in the scorotoron charger 15.

The first wire 71A for cleaner is anchored to a lower-rear end portion of the second part 43 of the wire holder 41 at a lower end thereof. From the anchored point, the first wire 71A extends upward and rightward along the left-side surfaces of the wire holder 41. More specifically, the first wire 71A reaching an upper corner in the second part 43 is bent thereat and extends rightward from the upper corner. The first wire 71A reaching the lower end of the first part 42 is bent thereat and extends further upward along the left-side surfaces of the first part 42. The first wire 71A reaching an upper corner in the first part 42 is bent thereat and extends further rightward. As the first wire 71A reaches a rightmost end in the first part 42, the first wire 71A is bent thereat and extends upward. Further, the first wire 71A is directed upper-frontward to be anchored to a top edge of the first part 43.

The second wire 71B for cleaner is anchored to a lower-rear end portion of the second part 43 of the wire holder 41 at a lower end thereof and is arranged in a frontward spaced-apart position with respect to the first wire 71. From the anchored point, the second wire 71B extends upward and rightward along the left-side surfaces of the wire holder 41. More specifically, the second wire 71B reaching the upper corner in the second part 43 is bent thereat and extends rightward from the upper corner. The second wire 71B reaching the lower end of the first part 42 is bent upward thereat and extends further upward along the left-side surfaces of the first part 42. The second wire 71B reaching the upper corner in the first part 42 is bent thereat and extends further rightward. As the second wire 71B reaches the rightmost end in the first part 42, the second wire 71B is bent thereat and extends upward. Further, the second wire 71B is directed upper-rearward to be anchored to a lower plane of the top edge of the first part 43 in a position spaced apart from the first wire 71A.

The wire 71C for grid is anchored to a lower-rear end portion of the second part 43 of the wire holder 41 at a lower end thereof and is arranged in a frontward spaced-apart position with respect to the second wire 71B. From the anchored point, the wire 71C for grid extends upward and rightward along the left-side surfaces of the wire holder 41. More specifically, the wire 71C reaching the upper corner in the second part 43 is bent thereat and extends rightward from the upper corner. The wire 71C reaching the lower end of the first part 42 is bent upward thereat and extends further upward along the left-side surfaces of the first part 42. The wire 71C reaching the upper corner in the first part 42 is bent thereat and extends further rightward. As the wire 71C reaches the rightmost end in the first part 42, the wire 71C is bent thereat and extends upward. The wire 71C is thereafter anchored to the top edge of the first part 43 in a frontward spaced-apart position with respect to the second wire 71B.

The wire 71D for developer roller is anchored to a lower-rear end portion of the second part 43 of the wire holder 41 at a lower end thereof and is arranged in a frontward spaced-apart position with respect to the wire 71C for grid. From the anchored point, the wire 71D for developer roller extends upward and rightward along the left-side surfaces of the wire holder 41. More specifically, the wire 71D reaching the upper corner in the second part 43 is bent thereat and extends rightward from the upper corner. The wire 71D reaching the lower end of the first part 42 is bent upward thereat and extends further upward along the left-side surfaces of the first part 42. The wire 71D reaching the upper edge in the first part 42 is bent thereat and extends further rightward. As the wire 71D reaches the rightmost end in the first part 42, the wire 71D is bent thereat and extends frontward. The wire 71D is thereafter anchored to a front edge of the first part 43 at a front end thereof.

The wire 71E for charger-wire is anchored to the lower-rear end portion of the second part 43 of the wire holder 41 at a lower end thereof and is arranged in a frontward spaced-apart position with respect to the wire 71D for developer roller. From the anchored point, the wire 71E for charger-wire extends upward and rightward along the left-side surfaces of the wire holder 41. More specifically, the wire 71E reaching the upper corner in the second part 43 is bent thereat and extends rightward from the upper corner. The wire 71E reaching the lower end of the first part 42 is bent upward thereat and extends further upward along the left-side surfaces of the first part 42. The wire 71E reaching the upper corner in the first part 42 is bent thereat and inclines further rightward and upper-rearward. As the wire 71E reaches an upper end of the inclination in the first part 42, the wire 71E is bent thereat and extends upward. As the wire 71E extends upward, the wire 71E crosses over the wire 71D for developer roller extending frontward. As the wire 71E reaches the rightmost end in the first part 42, the wire 71E is bent thereat and extends rearward. The wire 71E is thereafter anchored to the top edge of the first part 43 at an upper position with respect to the wire 71D for developer roller.

3.3 Attachment of the Wire Holder to the Lateral Wall

When the wire holder 41 is attached to the lateral wall 32, firstly, the lower edge of the second part 43 of the wire holder 41 is inserted in the opening 34 leftward from the right side of the lateral wall 32, and the engageable cylinders 47 are placed to encircle the engageable shafts 30 respectively in order for the engageable cylinders 47 to be engaged with the engageable shafts 30 (see FIGS. 6A, 6B, and 7A).

When the engageable cylinders 47 are thus engaged with the engageable shafts 30, the engageable shafts 30 can support the wire holder 41, and the lower edge of the second part 43 is exposed to the left side of the lateral wall 32 through the opening 34. In this regard, the engageable cylinders 47 are rotatable with respect to the engageable shafts 30.

Secondly, the wire holder 41 is rotated about the engageable shafts30 in clockwise, when viewed from rear, as indicated by a thick arrow in FIG. 7A. In this regard, the positioning shaft 38 on the lateral wall 32 is inserted in the shaft hole 45 formed in the wire holder 41, and the holder locking claw 36 on the lateral wall 32 is engaged with the engageable hole 45 formed in the wire holder 41 (see FIG. 4). With the engagement, the wire holder 41 is latched to the lateral wall 32.

When the wire holder 41 is latched to the lateral wall 32 as described above, the screw holes 39 of the screw cylinders 37 are exposed to the right side through the exposing holes 45. In this regard, the lower edge of the second part 43 is in contact with an edge area in the vicinity of the lower edge of the opening 34 on the left-side surface of the lateral wall 32.

Thirdly, screws (not shown) are inserted in the screw holes 39 and fastened. Thus, the wire holder 41 is attached to the lateral wall 32.

When the wire holder 41 is attached to the lateral wall 32, the first wire 71A for cleaner is placed in a position, in which a vertically extending contact section 74A (see FIG. 5) faces a right-side end of the first electrode 62A for cleaner. At the same time, the second wire 71B for cleaner is placed in a position, in which a vertically extending contact section 74B (see FIG. 5) faces a right-side end of the second electrode 62B for cleaner. Further, the wire 71C for grid is placed in a position, in which an upper contact section 74C (see FIG. 5) faces a right-side end of the electrode 62C for grid, and the wire 71D for developer roller is placed in a position, in which an frontward extending contact section 74D (see FIG. 5) faces a right-side end of the electrode 62D for developer roller. Furthermore, the wire 71E for charger-wire is placed in a position, in which a rearward extending contact section 74E (see FIG. 5) faces a right-side end of the electrode 62E for charger-wire.

4. Feeding Power to the Processing Unit

When the wire holder 41 holding the wires 71A-71E is thus attached to the lateral wall 32, the contact sections 74A-74E of the wires 71A-71E become in contact with the relay electrodes 61A-61E, which are exposed from the right-side ends of the relay electrode receptacles 62A-62E, respectively. Thereby, the wires 71A-71E are electrically connected with the relay electrodes 61A-61E.

Meanwhile, right-side ends of the electrodes 52A-52E on the high-voltage power feeder board 51 are in contact with the lower ends of the wires 71A-71E, which are on the left-hand side of the electrodes 52A-52E, respectively (see FIG. 8). Thereby, the wires 71A-71E are electrically connected with the electrodes 52A-52E.

Accordingly, the electrodes 52A-52E on the power feeder board 51 and the relay electrodes 61A-61E are respectively connected with each other. Further, when the processing unit 10 is installed in the printer 1, contact points (not shown) in the processing unit 10, which is on the left-hand side of the relay electrodes 61A-61E, are respectively in contact with the contact points 63 of the relay electrodes 61A-61E, (see FIG. 9). Thus, the high-voltage power feeder board 51 and the processing unit 10 are electrically connected with each other.

5. Effects

According to the printer 1 in the embodiment described above, the wire holder 41 to hold the wires 71A-71E, which electrically connect the high-voltage power feeder board 51 with the processing unit 10, is detachably attached to the outer side surface of the lateral wall 32. Therefore, a manufacturer worker is allowed to place the wires 71A-71E on the wire holder 41 prior to attaching the wire holder 41 to the lateral wall 32. Thus, the wires 71A-71E may be easily arranged on the wire holder 41 independently from the lateral wall 32, and when the wire holder 41 already holding the wires 71A-71E is attached to the lateral wall 32, the high-voltage power feeder board 51 and the processing unit 10 may be easily connected with each other. In other words, the wires 71A-71E connecting the processing unit 10 with the high-voltage power feeder board 51 electrically may be easily arranged in correct positions with respect to the lateral wall 32.

According to the printer 1 in the embodiment described above, further, the opening 34 penetrating the thickness of the lateral wall 32 along the widthwise direction is formed in the lateral wall 34, and the opening 34 allows the first part 42 of the wire holder to be disposed on the outer side of the lateral wall 32 and the second part 43 to be disposed on the inner side of the lateral wall 32 whilst the wires 71A-71E are arranged on the wire holder 41 to bridge over the first part 42 and the second part 43. Therefore, the manufacturer worker may set the wire holder 41 in the position to place the second part 43 on the inner side of the lateral wall 32 through the opening 34. Thus, the wires 71A-71E may be placed to bridge over the outer side and the inner side of the lateral wall 32 across the lateral wall 32 through the opening 34. Accordingly, the connection between the wires 71A-71E and the high-voltage power feed board 51 may be easily established.

According to the printer 1 in the embodiment described above, further, the electrodes 52A-52E on the high-voltage power feeder board 51 have conductivity and resiliency. Therefore, the electrodes 52A-52E can be placed in condition to be resiliently in contact with the wires 71A-71E. Furthermore, the second part 43 of the wire holder 41 is placed in a position on the left (inner) side of the lateral wall 32 to coincide with the edge area in the vicinity of the lower edge of the opening 34 on the left-side surface of the lateral wall 32, and the electrodes 52A-52E contacts inner sides of the wires 71A-71E on the second part 43 respectively from the left (inner side). In other words, the resilient electrodes 52A-52E apply rightward urging force to the wires 71A-71E placed on the second part 43 of the wire holder 41, and the urging force from the electrodes 52A-52E is borne eventually by the edge area in the vicinity of the lower edge of the opening 34 on the left-side surface of the lateral wall 32. Therefore, the wire holder 41 can be prevented from being deformed by the urging force whilst the electrodes 52A-52E and the wires 71A-71E can be firmly in contact with each other. Furthermore, by the urging force from the electrodes 52A-52E, the wire holder 41 may be maintained steady in the correct position with respect to the lateral wall 32. Therefore, it may not necessary to provide a fixing means, such as a screw and a screw hole, in the area in the vicinity of the second part 43 in the wire holder 41. Thus, the wire holder may be prevented from being formed in a larger size or may be downsized.

According to the printer 1 in the embodiment described above, the lateral wall 32 has the engageable shafts 30, which support the wire holder 41 rotatably and detachably, in the vicinity of the opening 34. Meanwhile, the wire holder 41 has the engageable cylinders 47, which can encircle the engageable shafts 30 to be engaged. Therefore, the wire holder 41 can be easily placed in the correct position with respect to the lateral wall 32 when attached to the lateral wall 32.

According to the printer 1 in the embodiment described above, the lateral wall 32 is made of the ABS resin, and the wire holder 41 is made of the PC/ABS resin. Therefore, the lateral wall 32 may be manufactured cost-moderately, whilst the wire holder 41 may be manufactured in higher cost for higher inflammability. Thus, the lateral wall 32 and the wire holder 41 may be manufactured in a preferable balance between the cost-effectiveness and the inflammableness.

According to the printer 1 in the embodiment described above, furthermore, the relay electrodes 62A-62E connecting the processing unit 10 with the wires 71A-71E have conductivity and resiliency. Therefore, the relay electrodes 62A-62E can be placed in condition to be resiliently in contact with the wires 71A-71E, and the relay electrodes 62A-62E and the wires 71A-71E can be steadily in contact with each other.

6. More Examples

Although an example of carrying out the invention has been described, those skilled in the art will appreciate that there are numerous variations and permutations of the image forming apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the embodiment described above, the wires 71A-71E are arranged on the left-side surfaces of the wire holder 41; however, some of the wires 71A-71E may be arranged on the right-side surfaces of the wire holder 41. For example, the wire 71E for charger-wire may be arranged on the right-side surfaces of the wire holder 41 whilst the first and the second wires 71A, 71B for cleaner, the wire 71C for grid, and the wire 71D for developer wire are arranged on the left-side surfaces of the wire holder 41. According to this arrangement, an insulating distance between the wire 71D for developer roller and the wire 71E for charger-wire may be substantially ensured, and the wire holder 41 may be downsized.

For another example, the frame structure in the printer 1 may not limited to the pair of lateral walls 32 but may include, for example, an upper frame, which horizontally connects upper sections of the lateral walls 32, and a bottom frame, which horizontally connects lower sections of the lateral walls 32. With the upper and the bottom frames in addition to the lateral walls 32, a four-sided frame structure to enclose the image forming unit 4 may be provided.

What is claimed is:

1. An image forming apparatus, comprising:

a main frame;

an image forming unit, which is disposed on an inner side of the main frame;

a power board, which is disposed on the inner side of the main frame and is configured to apply voltage to the image forming unit; and a holder member, which is detachably attached to a surface on an outer side of the main frame and is configured to hold a wire connecting the power board and the image forming unit electrically, wherein, when the holder member is attached to the main frame, the holder member is immovable relative to the main frame.

2. The image forming apparatus according to claim 1, wherein the main frame is formed to have an opening, through which the inner side and the outer side of the main frame are in communication with each other, wherein the holder member includes a first part configured to be disposed on the outer side of the main frame, and a second part, which extends continuously from the first part and is configured to be disposed on the inner side of the main frame through the opening, and wherein the wire is arranged on the holder member to bridge the first part and the second part.

3. The image forming apparatus according to claim 2, wherein the second part of the holder member is arranged in a position to coincide with an edge area, the edge area being in a vicinity of an edge of the opening on an inner surface of the main frame, wherein the power board includes a first electrode, the first electrode being conductive and resilient, and wherein the first electrode is in contact with an inner side of the wire arranged on the second part.

4. The image forming apparatus according to claim 2, wherein the main frame includes a supporting part, the supporting part configured to rotatably and detachably support the holder member in a proximate position to the opening, and wherein the holder member includes a supported part, the supported part configured to be rotatably and detachably supported by the supporting part.

5. The image forming apparatus according to claim 1, wherein the main frame is made of a material which is different from a material of the holder member.

6. The image forming apparatus according to claim 1, wherein the holder member is configured to hold a plurality of wires, the plurality of wires including at least one wire to be arranged on an inner side of the first part and at least one wire to be arranged on an outer side of the first part.

7. The image forming apparatus according to claim 1, further comprising:

a second electrode configured to connect the image forming unit and the wire electrically and to be conductive and resilient.

8. The image forming apparatus according to claim 1, further comprising:

a processing unit including a photosensitive drum, wherein the processing unit is removable from the main frame, through an opening formed on a side of the image forming apparatus, in a direction orthogonal to an axial direction of the photosensitive drum; and a cover configured to cover the opening, the cover being disposed at a position along the direction orthogonal to the axial direction of the photosensitive drum.

* * * * *